US009428899B2

(12) United States Patent
Friezner et al.

(10) Patent No.: US 9,428,899 B2
(45) Date of Patent: Aug. 30, 2016

(54) FLUID FLOW CONTROL AND DEBRIS INTERCEPTING APPARATUS

(71) Applicants: Denis Friezner, Granada Hills, CA (US); Scott Alberts, Burbank, CA (US)

(72) Inventors: Denis Friezner, Granada Hills, CA (US); Scott Alberts, Burbank, CA (US)

( * ) Notice: Subject to any disclaimer, the term of this patent is extended or adjusted under 35 U.S.C. 154(b) by 0 days.

(21) Appl. No.: 14/326,114

(22) Filed: Jul. 8, 2014

(65) Prior Publication Data

US 2015/0053598 A1 Feb. 26, 2015

Related U.S. Application Data

(63) Continuation-in-part of application No. 13/973,550, filed on Aug. 22, 2013, now Pat. No. 8,945,375.

(51) Int. Cl.
*E03F 5/04* (2006.01)

(52) U.S. Cl.
CPC ..... *E03F 5/0404* (2013.01)

(58) Field of Classification Search
None
See application file for complete search history.

(56) References Cited

U.S. PATENT DOCUMENTS 506,267 A * 10/1893 Sefton ..... E03F 1/00 210/131
528,821 A * 11/1894 Story ..... E04H 17/00 49/10
766,850 A * 8/1904 Smith ..... E04H 17/00 210/156
818,288 A * 4/1906 Race ..... B01D 17/0214 210/122
906,562 A * 12/1908 Rue ..... B01D 35/147 210/131
910,717 A * 1/1909 Olson ..... A01K 3/002 405/100
944,907 A * 12/1909 Powers ..... E02B 1/006 210/156
1,225,160 A * 5/1917 Nihart ..... 210/154
1,709,291 A * 4/1929 Vidler ..... E02B 5/085 210/155
1,861,031 A * 5/1932 Schmitt ..... E02B 3/04 210/162
1,999,637 A * 4/1935 Pettepher ..... E02B 1/006 210/113
2,018,580 A * 10/1935 Schonhoff ..... E02B 7/20 160/196.1
2,636,296 A * 4/1953 King ..... E04H 17/00 160/332
3,945,746 A * 3/1976 Bredbenner ..... E03F 5/06 210/163
4,110,216 A * 8/1978 Wagnon ..... B01D 35/28 210/156
4,356,087 A * 10/1982 Miles ..... B01D 29/0013 210/131
5,263,833 A * 11/1993 Robinson ..... E02B 8/085 405/80
6,015,489 A * 1/2000 Allen ..... E03F 5/0404 156/71
7,234,894 B1 * 6/2007 Flury ..... E03F 1/00 210/131
7,611,304 B2 * 11/2009 Lill ..... E01C 11/223 210/163
7,951,291 B2 * 5/2011 Nino ..... E03F 1/00 210/131
8,017,006 B2 * 9/2011 Lopez ..... E03F 1/00 210/163
8,043,498 B2 * 10/2011 Rueda ..... E03F 1/00 210/164
8,535,523 B2 * 9/2013 Friezner ..... F15D 1/0005 210/156
8,834,714 B2 * 9/2014 Chien ..... E03F 1/00 210/163
8,945,375 B2 * 2/2015 Friezner ..... E03F 5/0404 210/131
9,057,189 B2 * 6/2015 Flury ..... E03F 5/046
2012/0103883 A1 * 5/2012 Friezner ..... F15D 1/0005 210/156
2014/0041744 A1 * 2/2014 Friezner ..... E03F 5/0404 138/39

* cited by examiner

*Primary Examiner* — Robert James Popovics
(74) *Attorney, Agent, or Firm* — James E. Brunton

(57) ABSTRACT

A fluid flow control and debris intercepting apparatus for controlling the flow of fluid and the introduction of debris into the entrance of a water diversion system such as a curbside storm drain.

14 Claims, 13 Drawing Sheets

60a
92a
98
92
80a
80
118a
118
112
68
70
72
66
64
62
100
104a
94a
94
104
162
90a
90
88
86
111
106
108a
110a
108
110

FLUID FLOW CONTROL AND DEBRIS INTERCEPTING APPARATUS

CROSS-REFERENCE TO RELATED APPLICATIONS

This is a Continuation In Part of co-pending U.S. Ser. No. 13/973,550 filed Aug. 22, 2013.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to storm water control systems. More particularly, the invention concerns a fluid flow control and debris intercepting apparatus for controlling the flow of fluid and the introduction of debris into the entrance of a water diversion system such as a curbside storm drain.

2. Description of Related Art Including Information Disclosed under 37 CFR 1.97 and 1.98

The control of excess runoff rain water has long been a problem faced by municipalities throughout the civilized world. Heavy rainfall can create large volumes of runoff that must be handled effectively in order to avoid flooding, that can result in road closures and substantial property damage. Accordingly, most municipalities have installed drain systems that include curbside drains that are provided at spaced apart locations along most thoroughfares. The curbside drains typically lead to main drain pipes that carry the water to adjacent rivers, directly to the ocean, or to remote catch basins.

While the prior art drain systems have, for the most part, proven effective in carrying runoff storm water away from the streets and populated areas, the control of man-made and natural debris entering the drain systems remains a major problem. For this reason, various attempts have been made in the past to prevent unwanted debris from entering into curb side drains. These prior art attempts have included placing plates over the drains that are specially configured to trap the debris and still provide limited space for the water to flow. This approach has generally proven unsatisfactory because, as a general rule, the drains cannot adequately accommodate the runoff during heavy rainfall events. Other attempts have been made to design curbside drain gates that remain closed during dry periods, but open during moderate to heavy rainfall events.

U.S. Pat. No. 3,945,746 issued to Bredbenner illustrates one prior art approach to providing a specially configured catch basin curb inlet opening cover that comprises a rectangular grating panel that is adapted to be supported in a stationary frame surrounding and opening of a storm drain inlet. U.S. Pat. No. 7,611,304 issued to Lill et al. illustrates another prior art approach to providing a specially configured catch basin curb inlet opening cover.

U.S. Pat. No. 7,234,894 issued to Flury discloses an automatically openable and closable gate system for use with street side curb openings that includes a gate which during dry and low flow water drainage situations is in a closed position and during periods of heavy rainfall will automatically open. U.S. Publication No. 2008/0226390 discloses a system that is somewhat similar to the Flurry system and includes an automatic fluid channel screen lock-unlock system for automatically locking and unlocking a screen that is disposed within a fluid channel wherein the screen is rotatable relative to the channel from a closed position to an open position.

The prior art fluid channel screen lock-unlock systems have frequently proven to be unsatisfactory because the screens tend to jam in the locked position causing unwanted flooding.

BRIEF SUMMARY OF THE INVENTION

By way of brief summary, the present invention comprises a fluid flow control and debris intercepting apparatus for controlling the flow of fluid and the introduction of debris into the entrance of a conventional curbside storm drain of the character having spaced apart side walls that define a fluid flow channel through which fluid flows. In one form of the invention the apparatus comprises an elongated, yieldably deformable support in the form of a cable under tension that substantially spans the fluid flow channel and a plurality of transversely spaced apart flow control vanes that are connected to the cable. The flow control vanes function to control fluid flow through the curbside drain and work in tandem to block the entry of unwanted debris into the storm drain. To accomplish this purpose, the flow control vanes are pivotally movable between a first at rest position and a second position wherein an increase in fluid flow through the fluid flow channel is permitted. The system further includes a mechanism for controlling the tension in the elongated, yieldably deformable support cable and thereby controlling the resistance that is offered by the system to the flow of fluid through the fluid flow channel and the entry of objects into the storm drain.

With the forgoing in mind, it is an object of the present invention to provide an apparatus that effectively controls the flow of fluid and the introduction of unwanted debris into the entrance of a curbside storm drain.

Another object of the invention is to provide an apparatus that can readily be installed by unskilled workmen in curbside storm drains of varying standard and nonstandard construction.

Another object of the invention is to provide an apparatus of the aforementioned character that effectively prevents the entry of unwanted debris into curbside storm drains during conditions of low to moderate rainfall, but may permit the free entry of debris into the storm drain during conditions of heavy rainfall.

Another object of the invention is to provide an apparatus of the class described that can be specially tailored to accommodate directional fluid flow as, for example, downhill fluid flow.

Another object of the invention is to provide an apparatus of the described in the preceding paragraph which, because of its unique design, cannot jam and will automatically open to permit fluid flow through the flow control channel when the flowing water impinges upon control vanes.

Another object of the invention is to provide an apparatus as described in the preceding paragraphs that is easy to install and in no way affects the structural integrity of the curbside storm drain.

Another object of the invention is to provide an apparatus of the class described in which the flow control vanes of the apparatus can be readily modified for use in storm drains of varying height and width.

Another object of the invention is to provide an apparatus of the class described in the preceding paragraph which, because of the unique design of the light weight flow control vanes of the apparatus, permits a significantly higher flow volume of water through the fluid flow channel than is permitted by prior art devices embodying perforated flow control gates.

Another object of the invention is to provide an apparatus as described in the preceding paragraphs that is easily adjustable to accommodate varying fluid flow conditions.

Another object of the invention is to provide an apparatus of the class described in which advertising indicia can readily be imprinted on the exposed faces of the flow control vanes of the apparatus.

Another object of the invention is to provide an apparatus of the type described in the preceding paragraphs which when installed in no way obstructs travel along the street where the curbside storm drains are installed.

Another object of the invention is to provide a fluid flow control system that embodies materials that have little recyclable value so as to discourage theft of the apparatus for potential resale.

Another object of the invention is to provide an apparatus of the class described that is durable in use and one that can be inexpensively manufactured, installed and maintained.

DETAILED DESCRIPTION OF THE INVENTION

Figure 1:
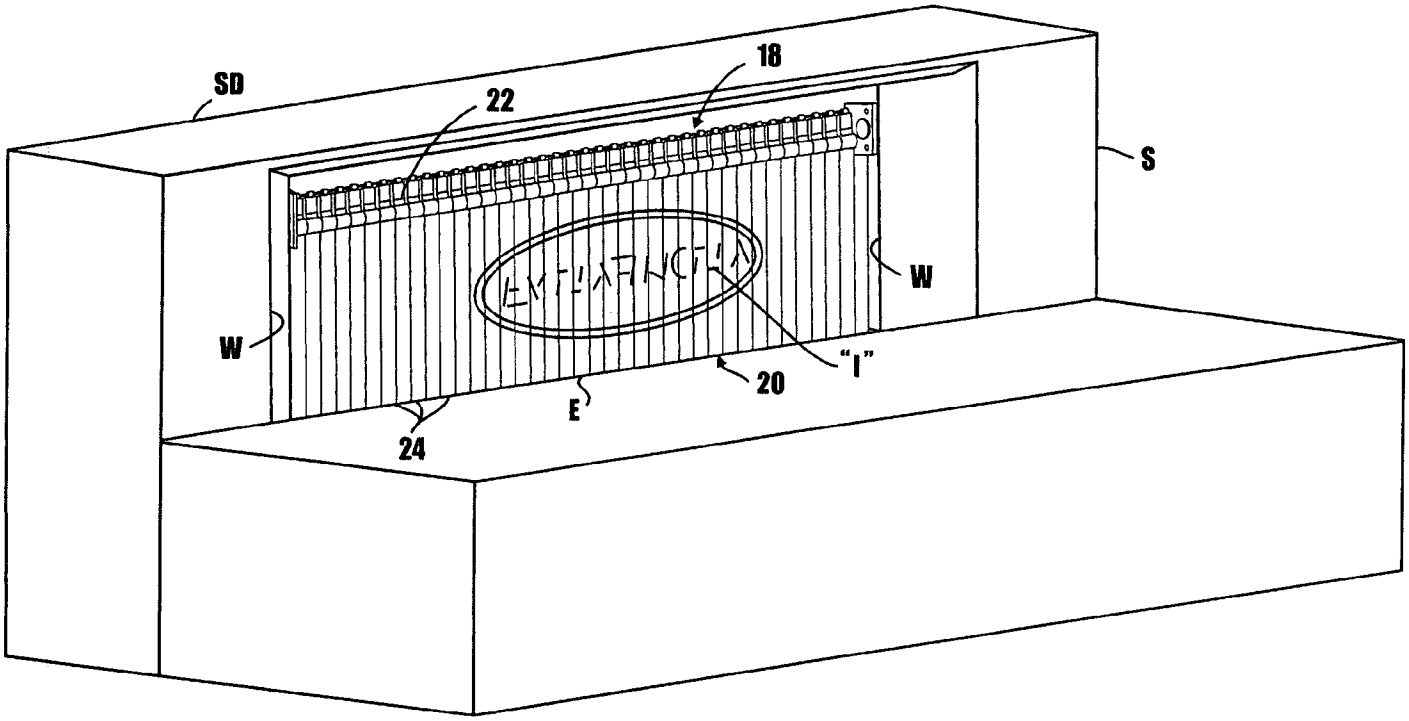
FIG. 1 is a generally perspective front view of one form of the fluid flow control and debris intercepting apparatus as it appears when installed in a conventional curbside storm drain.
Figure 2:
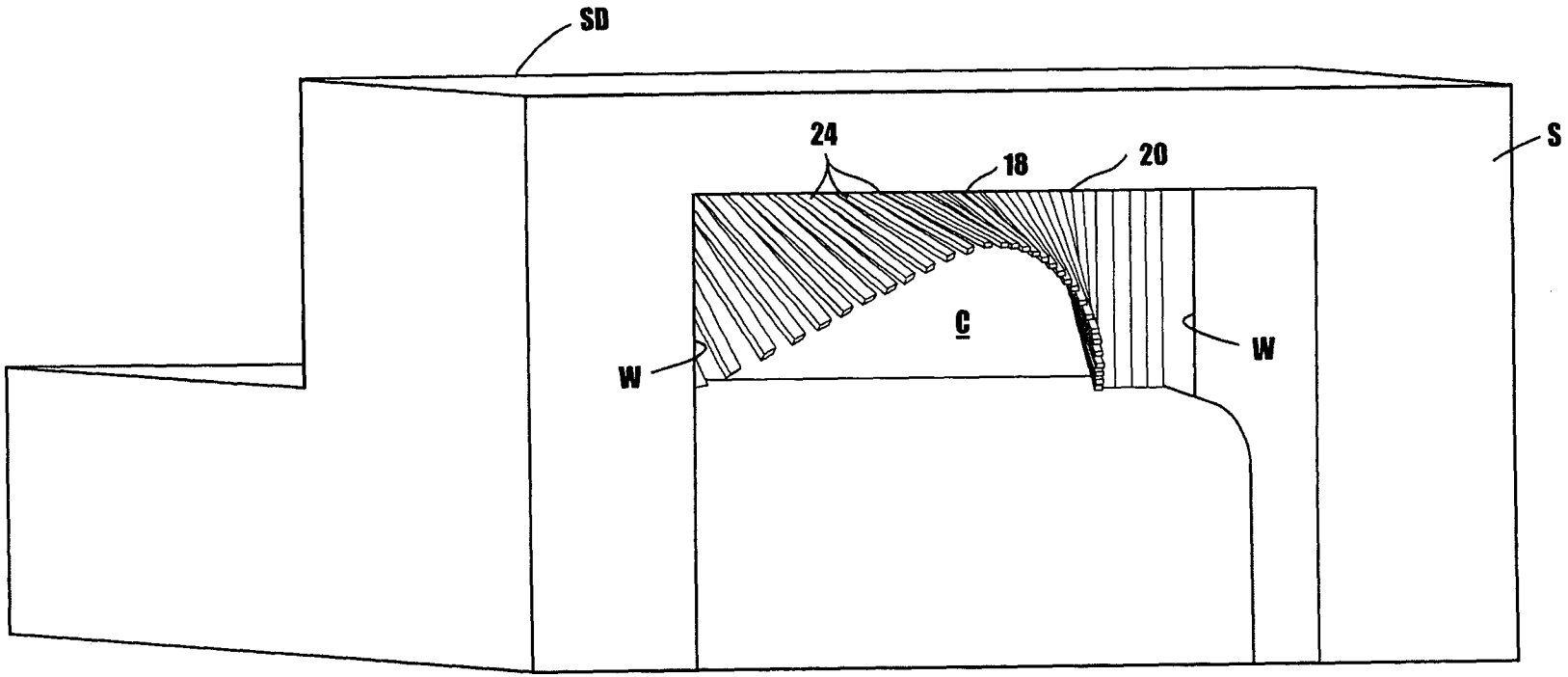
FIG. 2 is a generally perspective rear view similar to FIG. 1, but showing the fluid flow control and debris intercepting apparatus in an open position to permit fluid and debris flow through the flow channel of the storm drain.
Figure 3:
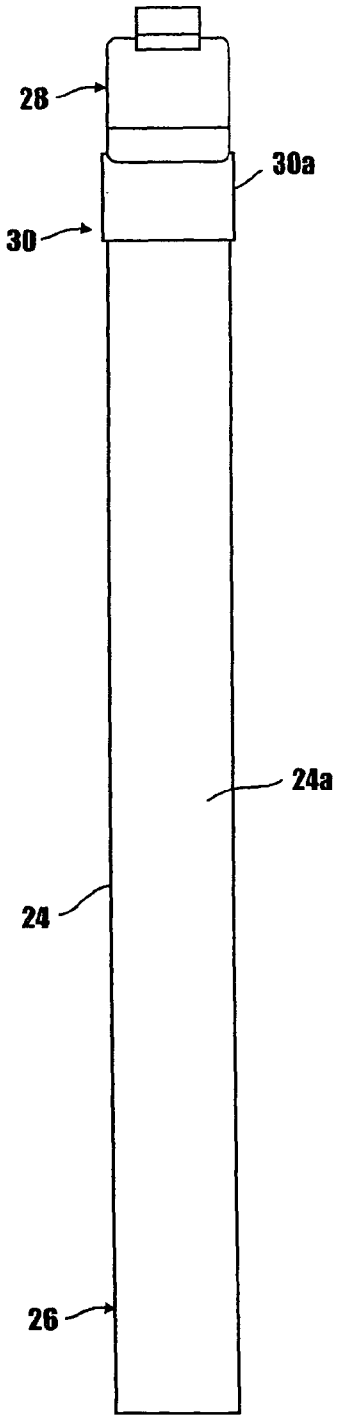
FIG. 3 is a greatly enlarged front view of one form of the control vane of the apparatus of the invention.
Figure 4:
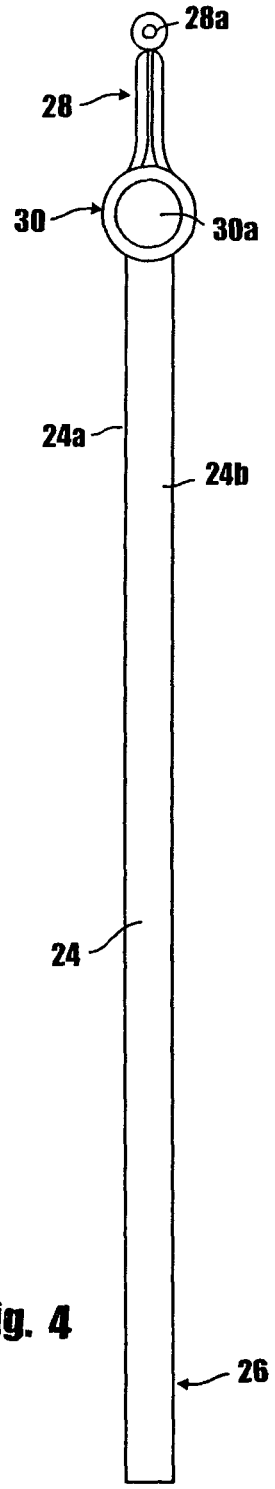
FIG. 4 is a greatly enlarged side view of the control vane shown in FIG. 3.
Figure 5:
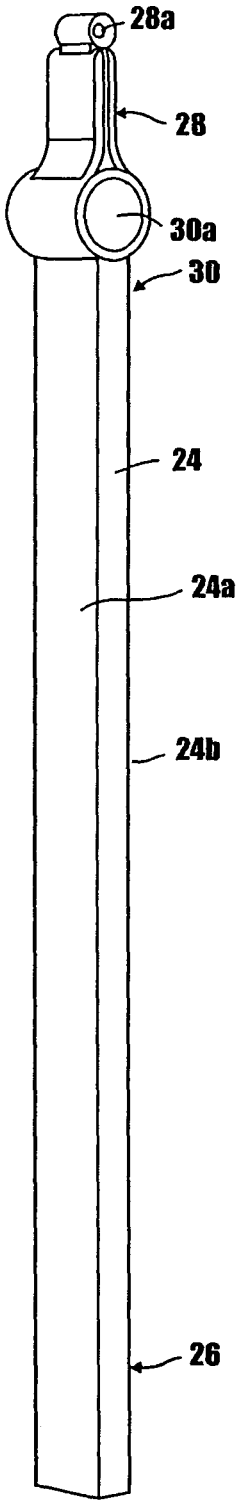
FIG. 5 is a greatly enlarged, generally perspective view of the control vane shown in FIG. 3.
Figure 6:
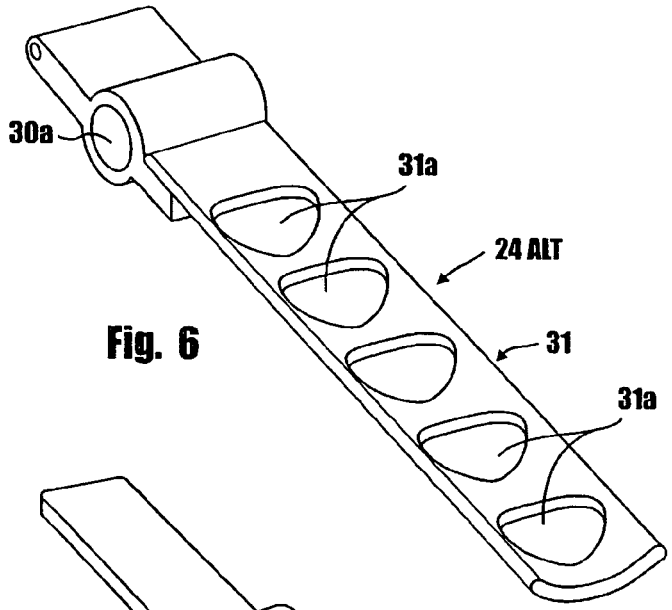
FIG. 6 is a greatly enlarged, generally perspective view of an alternate form of control vane.
Figure 6A:
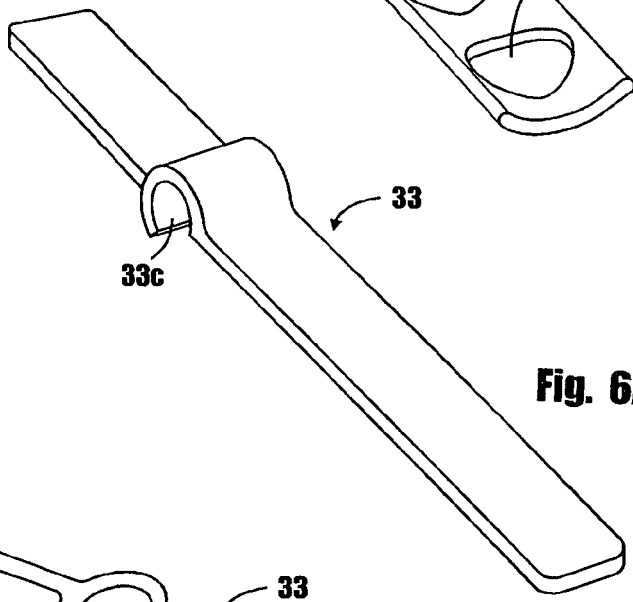
FIG. 6A is a greatly enlarged, generally perspective top view of still another alternate form of control vane.
Figure 6B:
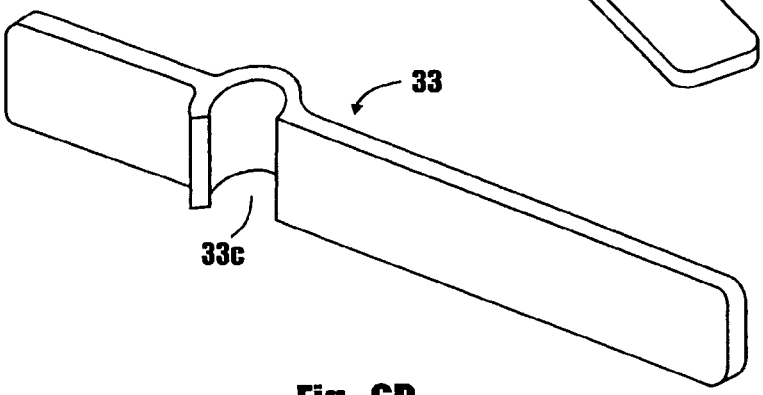
FIG. 6B is a greatly enlarged, generally perspective bottom view of the control vane shown in FIG. 6A.

Referring to the drawings and particularly to FIGS. 1 and 2, one form of the fluid flow control and debris intercepting apparatus of the invention is there shown as it appears when positioned within the conventional curbside storm drain. This form of the apparatus, which is generally designated in the drawings by the numeral 18, functions to control the flow of fluid and the introduction of debris into the entrance "E" of the storm drain "SD" that comprises a structure "S" having spaced apart side walls "W" that define a fluid flow channel "C" (FIG. 2) through which fluid, such as rainwater flows. In the form of the invention shown in FIGS. 1 through 2 the apparatus comprises a control gate assembly 20 that includes a support member 22 that is connected to structure "S" and spans the fluid flow channel "C". Support number 22 is here shown as an elongated, generally cylindrically shaped pivot rod having extremities that are disposed in engagement with the sidewalls "W" of the structure "S" (FIG. 1). Pivotally connected to support member 22 for movement between a first at rest position and a second position are a plurality of transversely spaced apart uniquely configured flow control vanes 24. Flow control vanes 24, which also comprise a part of the fluid flow control and debris intercepting gate 20, uniquely function to control fluid flow through the fluid flow channel "C" and to selectively block the entrance of debris into the channel. As shown in FIGS. 3, 4, and 5 of the drawings, each of the flow control vanes 24 has a front face 24*a*, a rear face 24*b*, a lower portion 26, an upper portion 28 and an intermediate portion 30. As best seen in FIGS. 4 and 5, the intermediate portion 30 of each of the flow control vanes is provided with an opening 30*a* that is constructed and arranged to slidably receive the support member 22. More particularly, in the form of in the invention shown in these figure drawings, the opening is provided in the form of a transverse bore that is constructed and arranged to slidably receive the support member 22. In an alternate form of flow control, vane 24ALT which is of the somewhat similar configuration shown in FIG. 5, the lower portion 31 of the control vane is curved and is provided with a plurality of spaced apart openings 31*a*. In another alternate form of flow control vane 33, which as of the configuration shown in FIGS. 6A and 6B of the drawings, the opening is provided in the form of a semicircular opening 33*c* that is constructed and arranged to releasably grip the support member 22. As indicated in FIG. 1 of the drawings, if desired, indicia such as advertising indicia "I" can be imprinted on the face of the control vanes 24.

Referring now to FIGS. 7 through 12 of the drawings, an alternate form of the fluid flow control and debris intercepting apparatus of the invention is there shown and generally designated by the numeral 56. This form of the apparatus is similar in many respects to the apparatus shown in FIGS. 1 through 6 of the drawings and operates in a somewhat similar Manner to control the flow of fluid and the introduction of debris into the entrance of the storm drain "SD-1" that comprises a structure "S-1" having spaced apart side walls "W-1" that define a fluid flow channel "C-1" (FIGS. 7 and 8) through which fluid, such as rainwater flows.

Figure 7:
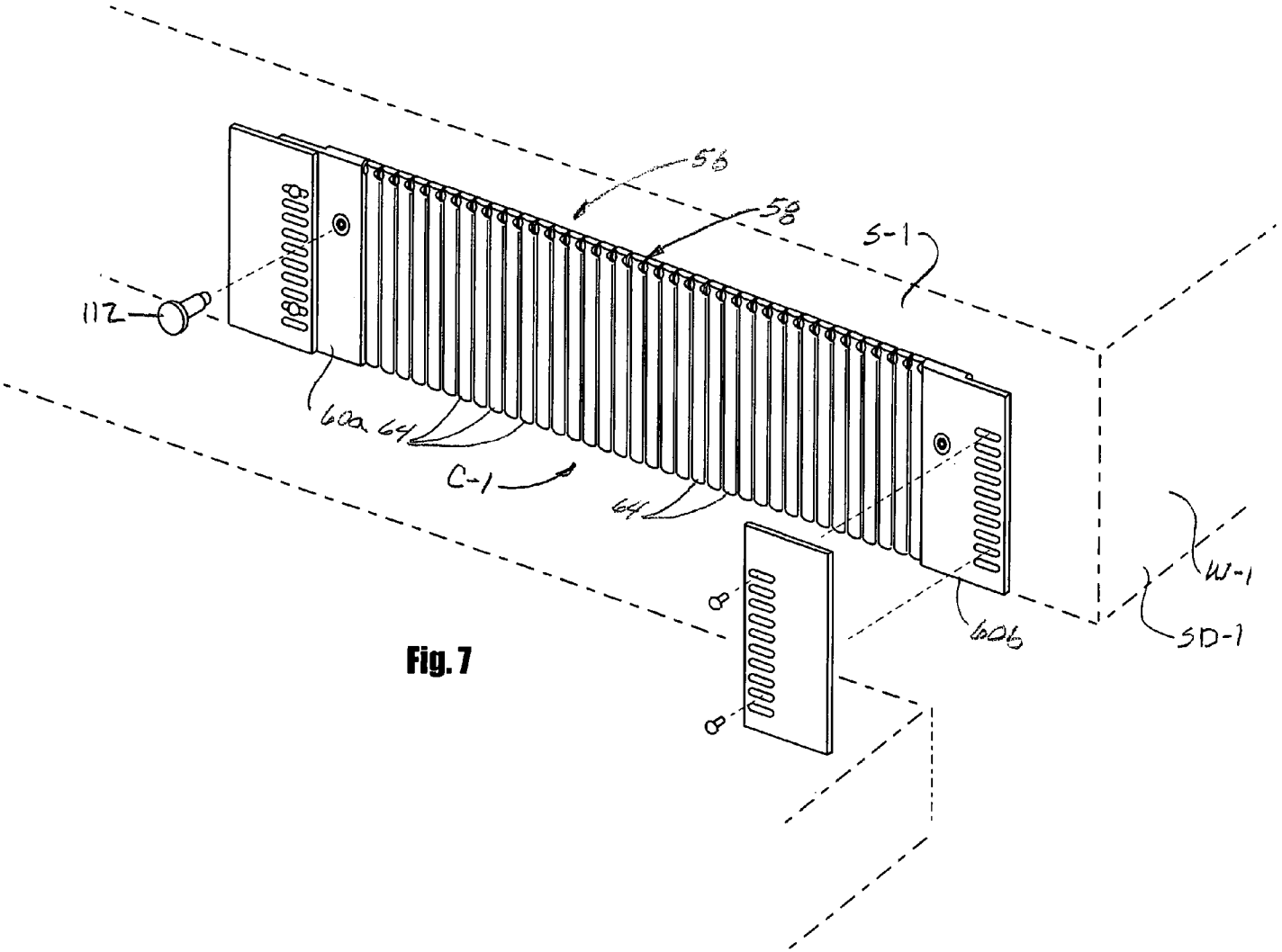
FIG. 7 is a generally perspective, exploded view of an alternate form of the fluid flow control and debris intercepting apparatus showing the control gate in its closed position.
Figure 8:
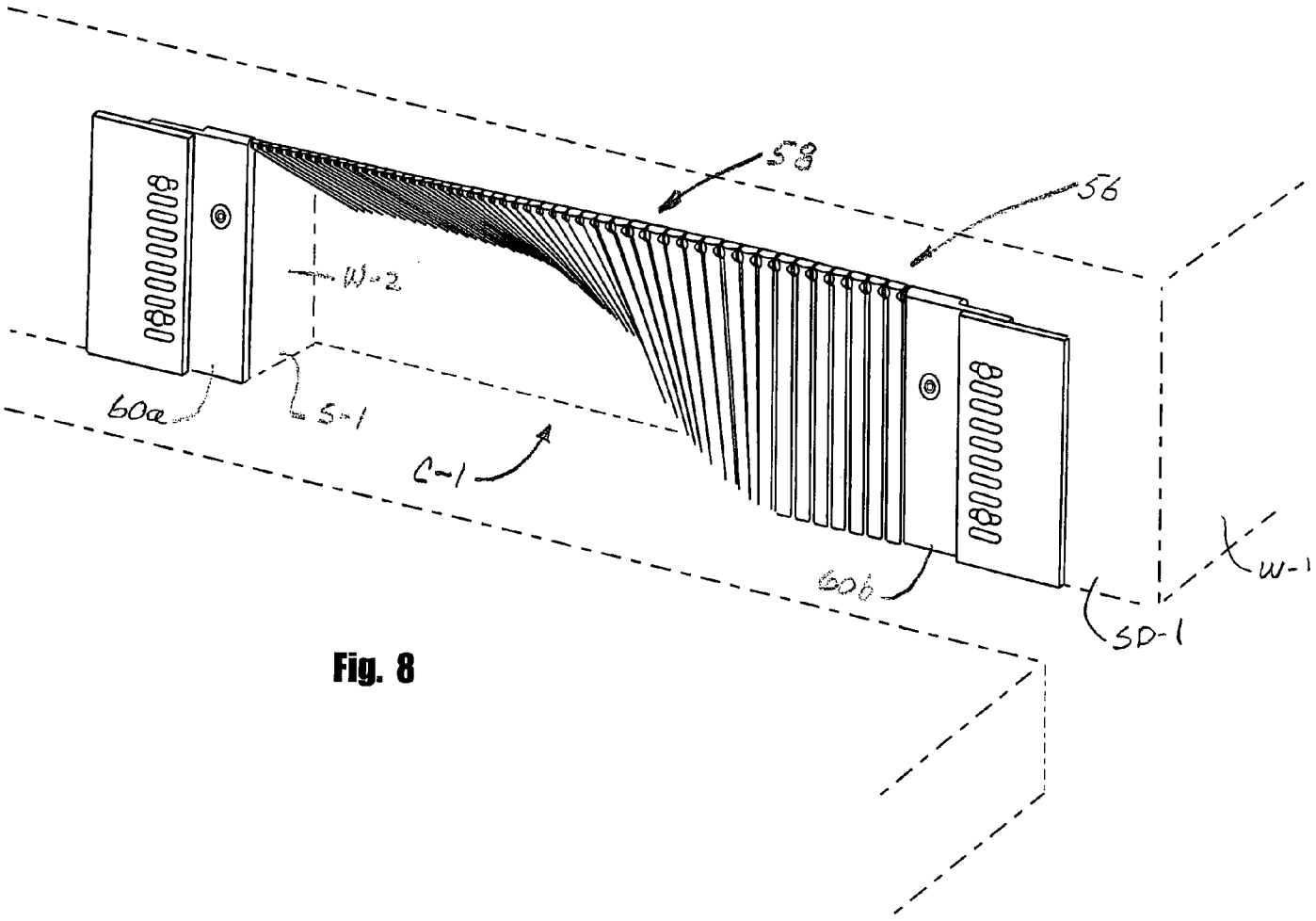
FIG. 8 is a generally perspective view similar to FIG. 7, but showing the fluid flow control and debris intercepting apparatus in an open position to permit fluid and debris flow through the flow channel of the storm drain.
Figure 9:
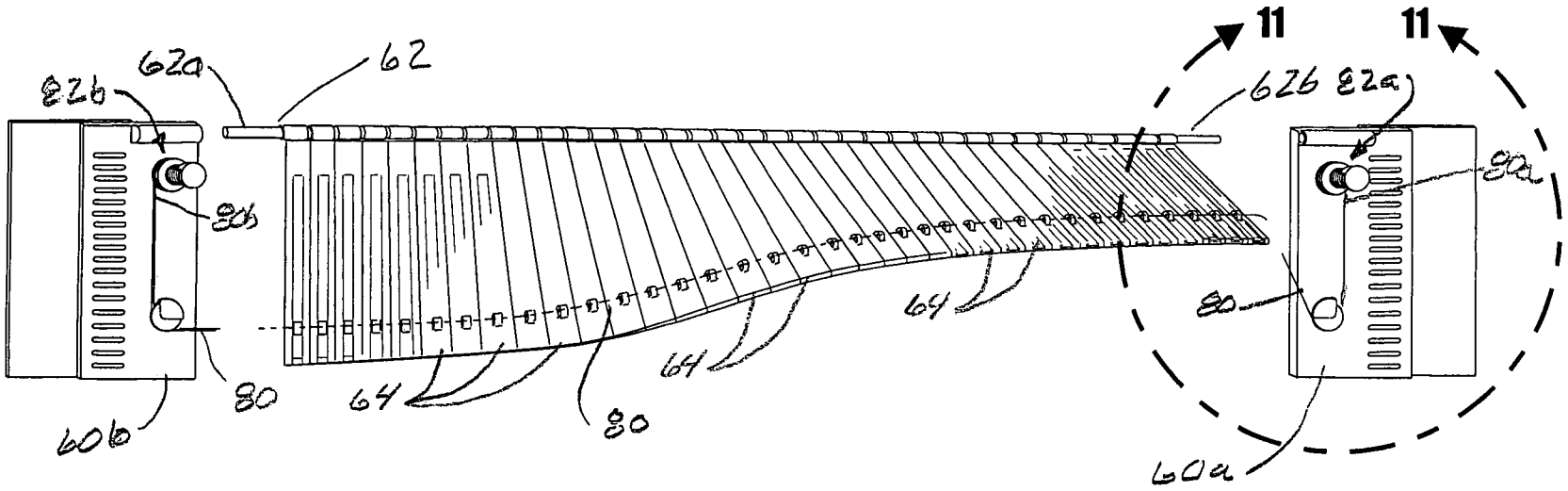
FIG. 9 is a generally perspective, exploded rear view of the control gate portion of the fluid flow control and debris intercepting apparatus in its open position.

Apparatus 56 here comprises a control gate assembly 58 that includes a pair of side panels 60*a* and 60*b* that are connected to structure "S-1" in the manner shown in FIGS. 7 and 8. Connected to and spanning the side panels is an elongated support member 62 here shown as an elongated, generally cylindrically shaped pivot rod having first and second extremities 62*a* and 62*b* that are disposed in engagement with the side panels 60*a* and 60*b* (FIG. 9). Pivotally connected to support member 62 for movement between a first at rest position and a second position are a plurality of transversely spaced apart uniquely configured flow control vanes 64.

Figure 10A:
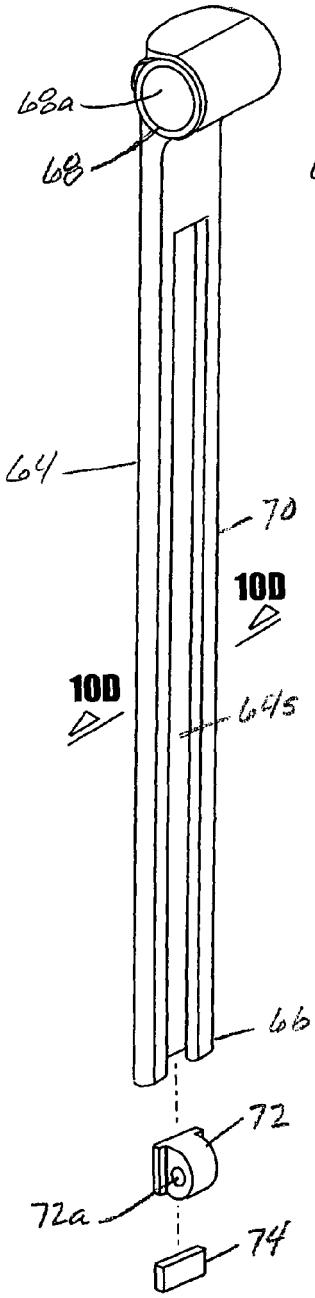
FIG. 10A is a greatly enlarged, generally perspective, exploded view of one of the control vanes of the apparatus of this latest form of the invention.
Figure 10B:
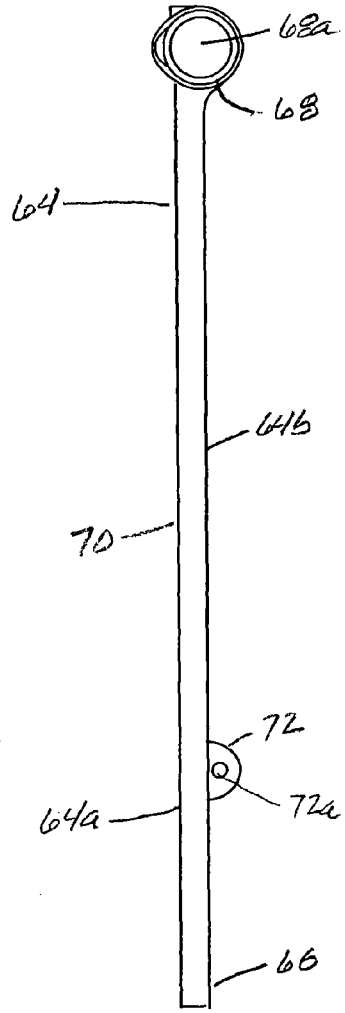
FIG. 10B is a side view of the control vane shown in FIG. 10A.
Figure 10C:
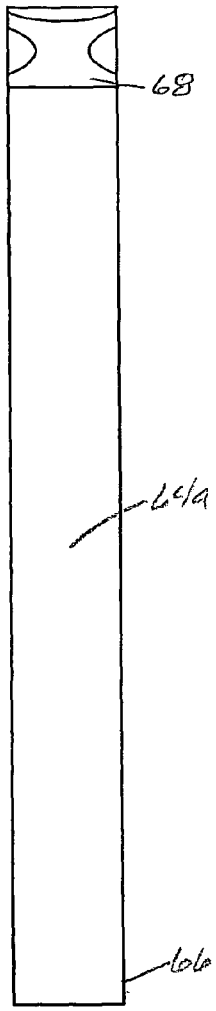
FIG. 10C is a front view of the control vane shown in FIG. 10A.
Figure 10D:
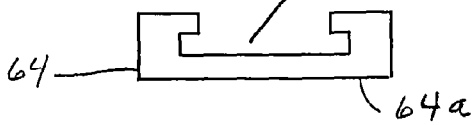
FIG. 10D is an enlarged, cross-sectional view taken along lines 10D-10D of FIG. 10A.

Flow control vanes 64, which comprise a part of the fluid flow control and debris intercepting gate, uniquely function to control fluid flow through the fluid flow channel "C-1" and to selectively block the entrance of debris into the channel. As shown in FIGS. 10A, 10B, 10C and 10D of the drawings, each of the flow control vanes 64 has a front face 64*a*, a rear face 64*b*, a lower portion 66, an upper connector portion 68 and an intermediate portion 70. As best seen in FIG. 10A, the upper connector portion 68 of each of the flow control vanes is provided with an opening 68*a* that is constructed and arranged to slidably receive the support member 62. More particularly, in this latest form of the invention, the opening is provided in the form of a transverse bore that is constructed and arranged to slidably receive the support member 62. As shown in FIG. 10A, each of the flow control vanes 64 is provided with a longitudinally extending slot 64*s* that slidably receives an apertured cable receiving member 72 and a closure member 74 that closes the lower extremity of the slot.

As before, an important aspect of the apparatus of this latest form of the invention is an elongated, biasing member, shown here as an elongated, yieldably deformable biasing cable 80 (FIGS. 9 and 11) having a first end 80*a* and a second end 80*b*. Cable 80 is received within openings 72*a* formed in the apertured cable receiving members 72 that are slidably received within slot 64*s* (FIG. 10A) and are affixed to the control vanes 64 at the location illustrated in FIG. 10B. Cable 80 uniquely functions to controllably resist movement of the vanes toward their second position. In a manner presently to be described, cable 80 is continuously maintained in tension and the degree of tension in the cable is regulated by first and second cooperating tensioning mechanisms 82*a* and 82*b* that are connected to cable 80 and are carried by the side panels 60*a* and 60*b*. These important tensioning mechanisms, which are of identical construction and operation, each comprise a generally circular shaped connector plate 86 that is connected to a selected one of the side panels and an elongated hollow cylindrical member 88 that is affixed to the connector plate and extends outwardly there from. Disposed internally of hollow cylindrical member 88 is a female driving member 90 that is provided with a multiplicity of circumferentially spaced spline receiving grooves 90*a* (see FIG. 12). Circumscribing hollow cylindrical member 88 is a circular shaped cable spool 92 about which the cable 80 is entrained. Connected to cable spool 92 and also circumscribing hollow cylindrical member 88 is a conventional helical torsion spring 94 that has first and second ends 94*a* and 94*b* respectively. Helical torsion spring 94 functions to provide controlled resistance to the rotation of the cable spool 92 and to in this way control the degree of tension in the cable. Connected to the second end of the torsion spring 94 is a tensioning assembly 98, which is operably associated with driving member 90 and which, in a manner presently to be described, functions to controllably twist the torsion spring. Tensioning assembly 98 here includes a generally circular shaped connector plate 100, which includes an outwardly extending, generally arcuate shaped spring engaging segment 102. Also forming a part of the tensioning assembly 98 is an internally threaded, male driven member 104 that is provided with a multiplicity of circumferentially spaced splines 104*a* that are receivable within the spline receiving grooves 90*a* of driving member 90. Threadably connected to male driven member 104 and extending through hollow cylindrical member 88 is an elongated, generally cylindrical member 106. Slidably connected to the outboard end of hollow cylindrical member 88 for movement between an at rest position and an inward position is an actuating assembly 108 that includes a collar 108*a* that circumscribes elongated cylindrical member 106. Affixed to collar 108*a* is an actuating driver 110 that is provided with a multiplicity of circumferentially spaced splines 110*a* that are receivable within the spline receiving grooves 90*a* of driving member 90 when the actuating assembly 108 is moved into its inward position. Circumscribing elongated cylindrical member 106 and housed within hollow cylindrical member 88 is a biasing spring 111 that functions to yieldably resist inward movement of the actuating assembly 108.

Figures 11, 12:
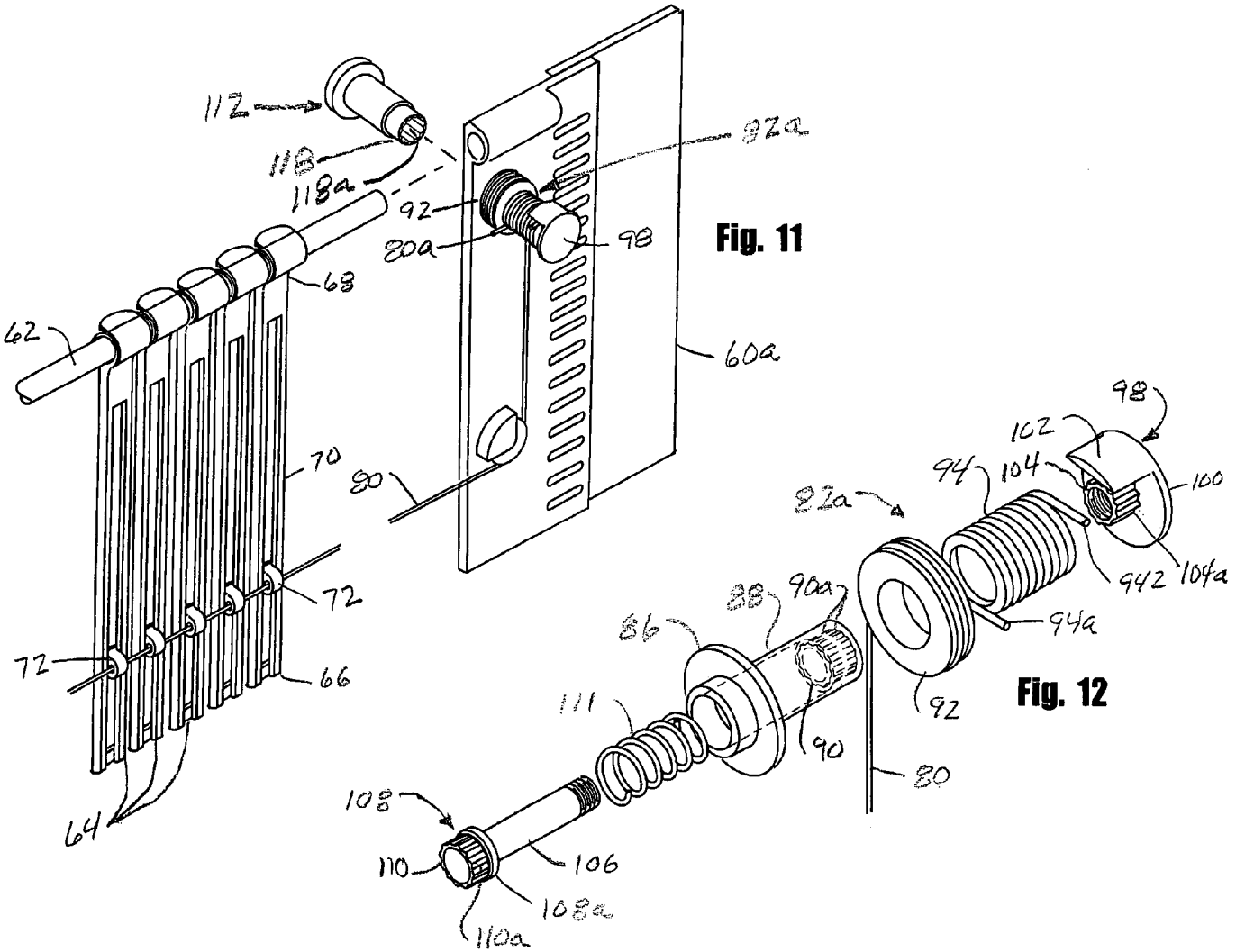
FIG. 11 is an enlarged, generally perspective, exploded view of the area designated in FIG. 9 as 11-11.
FIG. 12 is an enlarged, generally perspective, exploded view of one form of the tensioning mechanism of this latest form of the invention for controlling the tension of the elongated tensioning cable of the invention.

Each of the first and second cooperating tensioning mechanisms 82*a* and 82*b* are manually operated by an operating assembly 112 that can be operably associated with actuating drivers 110. Operating assembly 112, which functions to controllably rotate the actuating drivers 110 and, in turn, rotate the driving members 90, includes a generally cylindrically shaped body 114, a hand gripping head portion 116 and a connector end 118. As best seen in FIG. 11, connector end 118 is provided with a multiplicity of circumferentially spaced spline receiving grooves 118*a* that receive splines 110*a* of actuating driver 110 when the operating assembly 112 is mated with the actuating drivers 110.

In using the fluid flow control and debris intercepting apparatus of this latest form of the invention, the cable 80 can be appropriately tensioned through the alternate use of the first and second cooperating tensioning mechanisms 82*a* and 82*b*. This tensioning step is accomplished by inserting the connector end of the manually operated, operating assembly 112 into the selected tensioning mechanism in a manner such that splines 110*a* of actuating driver 110 are received within the multiplicity of circumferentially spaced spline receiving grooves 118*a* of the operating assembly 112. Manual rotation of the operating assembly 112 will controllably rotate the actuating driver 110, which will rotate the driving member 90 and, in turn, will rotate driven member 104 and connector plate 100. Rotation of the connector plate 100 will cause the arcuate shaped spring engaging segment 102 to controllably twist the torsion spring 94 and controllably rotate the spool 92. In this way the resistance offered to the rotation of the circular shaped cable spool 92 about which the cable 80 is entrained can be selectively controlled.

As before, as the water flows through the fluid flow channel "C" and impinges on the control vanes 64, the lower portions of the control vanes will tend to move outwardly in the manner shown in FIG. 8 of the drawings. However, since the lower portions of the control vanes are interconnected with the cable 80, the cable will yieldably resist the outward movement of the control vanes, which outward movement is tending to move the cable into an arcuate configuration (FIG. 9). It is apparent that the degree of tension placed on the cable 80 controls the amount of force that must be imparted on the control vanes by the flowing fluid to move the cable into the arcuate configuration shown in FIG. 9. The greater the tension on the cable 80, the greater is the force against the fluid flowing through the fluid flow channel "C" and impinging on the control vanes that is required to move the cable into an arcuate configuration as is illustrated in FIG. 9 and to move the control gate into an open position. Conversely, the lesser the tension on the cable 80, the lower is the force against fluid flowing through the fluid flow channel "C" and impinging on the control vanes that is required to move the control gate into an open position.

Figure 13:
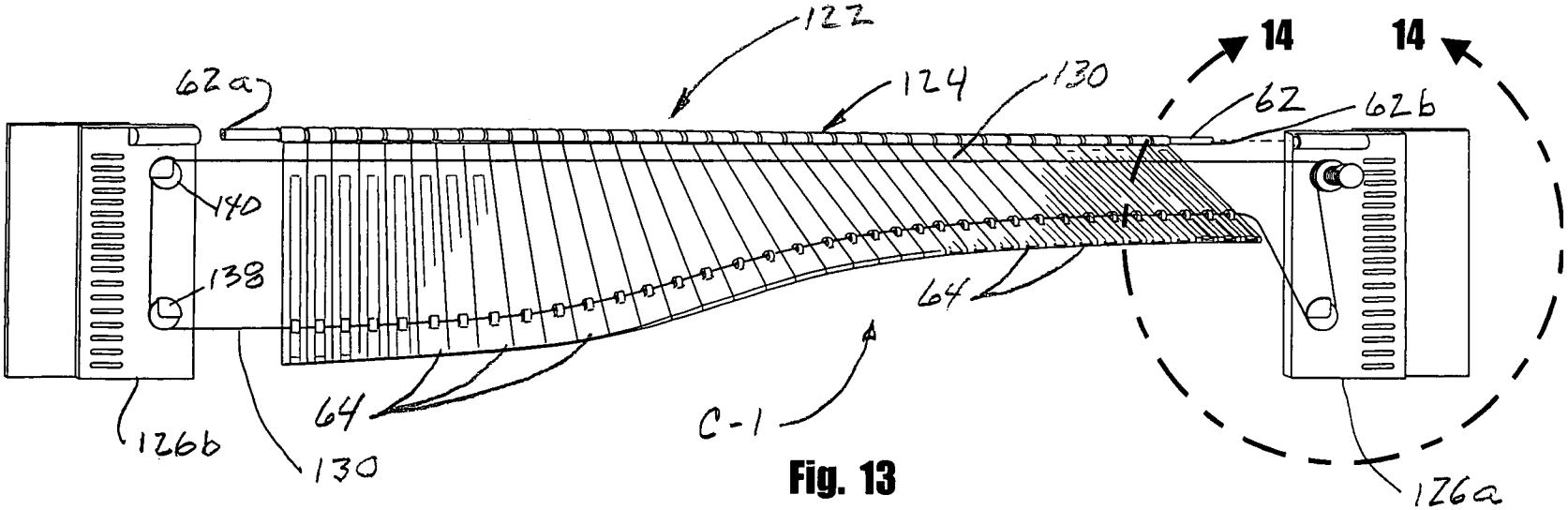
FIG. 13 is a generally perspective, exploded rear view of the control gate portion of still another form of the fluid flow control and debris intercepting apparatus of the invention showing the apparatus in its open position.
Figures 14, 15:
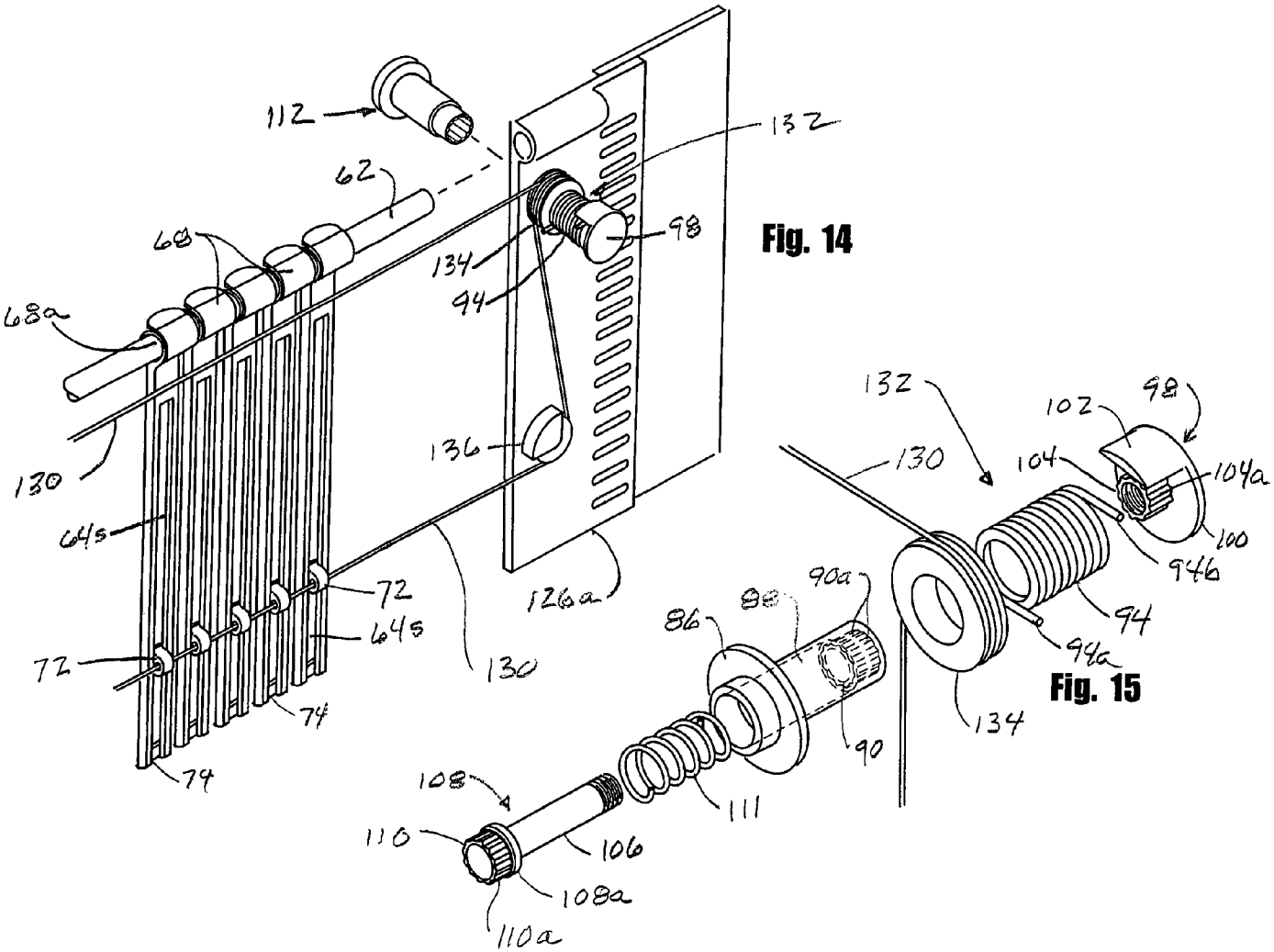
FIG. 14 is an enlarged, generally perspective, exploded view of the area designated in FIG. 13 as 14-14.
FIG. 15 is an enlarged, generally perspective, exploded view of an alternate form of the tensioning mechanism of this latest form of the invention for controlling the tension of the elongated tensioning cable of the invention.
Figure 16:
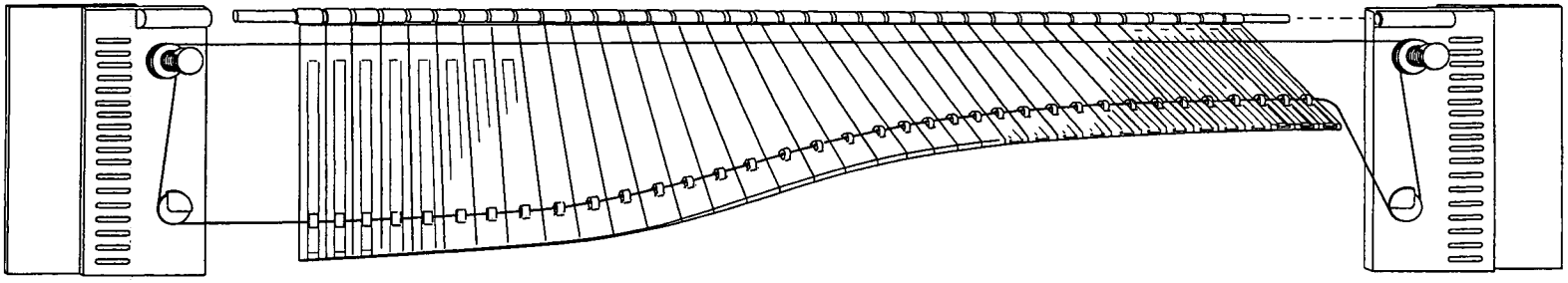
FIG. 16 is a generally perspective rear view of an alternate form of the fluid flow control and debris intercepting apparatus as it appears when installed in the conventional curbside storm drain.

Referring now to FIGS. 13 and 14 of the drawings, still another form of the fluid flow control and debris intercepting apparatus of the invention is there shown and generally designated by the numeral 122. This form of the apparatus is similar in many respects to the apparatus shown in FIGS. 7 through 12 of the drawings and like numerals are used in FIGS. 13 and 14 to identify like components. As before, the apparatus operates in a manner to control the flow of fluid and the introduction of debris into the entrance C-1 of the storm drain.

Apparatus 122 here comprises a control gate assembly 124 that includes a pair of side panels 126*a* and 126*b* that are connected to structure "S-1". Connected to and spanning the side panels is an elongated support member 62 here shown as an elongated, generally cylindrically shaped pivot rod having first and second extremities 62*a* and 62*b* that are disposed in engagement with the side panels 126*a* and 126*b* (FIG. 13). Pivotally connected to support member 62 for movement between a first at rest position and a second position are a plurality of transversely spaced apart uniquely configured flow control vanes 64.

Flow control vanes 64, which are identical construction and operation to those previously described, comprise a part of the fluid flow control and debris intercepting gate, that uniquely function to control fluid flow through the fluid flow channel "C-1" and to selectively block the entrance of debris into the channel. As shown in FIGS. 10A, 10B, 10C and 10D of the drawings, each of the flow control vanes 64 has a front face 64*a*, a rear face 64*b*, a lower portion 66, an upper connector portion 68 and an intermediate portion 70. As best seen in FIG. 10A, the upper connector portion 68 of each of the flow control vanes is provided with an opening 68*a* that is constructed and arranged to slidably receive the support member 62. More particularly, in this latest form of the invention, the opening is provided in the form of a transverse bore that is constructed and arranged to slidably receive the support member 62. As shown in FIG. 10A, each of the flow control vanes 64 is provided with a longitudinally extending slot 64*s* that slidably receives an apertured cable receiving member 72 and a closure member 74 that closes the lower extremity of the slot.

As before, an important aspect of the apparatus of this latest form of the invention is an elongated, biasing member, shown here as an elongated, yieldably deformable, continuous biasing cable 130 (FIGS. 13 and 14). Cable 130 is received within openings 72*a* formed in the apertured cable receiving members 72 that are affixed to the control vanes 64 (see FIGS. 13 and 15). Cable 130 uniquely functions to controllably resist movement of the vanes toward their second position. In this latest embodiment of the invention the tension in cable 130 is continuously maintained by a single tensioning mechanism 132 that is carried by side panel 126*a*. This important tensioning mechanism, which is of similar construction and operation to the previously described tensioning mechanisms 82*a* and 82*b*, comprises a generally circular shaped connector plate 86 that is connected to side panel 126*a* and an elongated hollow cylindrical member 88 that is affixed to the connector plate and extends outwardly there from. Disposed internally of hollow cylindrical member 88 is a female driving member 90 that is provided with a multiplicity of circumferentially spaced spline receiving grooves 90*a* (see FIG. 15). Circumscribing hollow cylindrical member 88 is a circular shaped cable spool 134 about which the cable 130 is entrained. As illustrated in FIGS. 13, 14 and 15 of the drawings, cable 130 passes around cable spool 134, downwardly around a pulley 136 mounted on side plate 126*a*, longitudinally through the apertured cable receiving member 72, around a lower pulley 138 mounted on plate 126*b*, upwardly around an upper pulley 140 mounted on plate 126*b*, longitudinally across the upper, rear surfaces of the flow control vanes 64 and finally once again around cable spool 134 thus forming a continuous loop. Connected to cable spool 134 and also circumscribing hollow cylindrical member 88 is a conventional helical torsion spring 94 that has first and second ends 94*a* and 94*b* respectively. Connected to the second end of the torsion spring 94 is a tensioning assembly 98, which is operably associated with driving member 90 and which, in a manner presently to be described, functions to controllably twist the torsion spring. Tensioning assembly 98 here includes a generally circular shaped connector plate 100, which includes an outwardly extending, generally arcuate shaped spring engaging segment 102. Also forming a part of the tensioning assembly 98 is an internally threaded, male driven member 104 that is provided with a multiplicity of circumferentially spaced splines 104*a* that are receivable within the spline receiving grooves 90*a* of driving member 90. Threadably connected to male driven member 104 and extending through hollow cylindrical member 88 is an elongated, generally cylindrical member 106. Slidably connected to the outboard end of hollow cylindrical member 88 for movement between an at rest position and an inward position is an actuating assembly 108 that includes a collar 108*a* that circumscribes cylindrical member 106. Affixed to collar 108*a* is an actuating driver 110 that is provided with a multiplicity of circumferentially spaced splines 110*a* that are receivable within the spline receiving grooves 90*a* of driving member 90 when the actuating assembly 108 is moved into its inward position. Circumscribing cylindrical member 106 and housed within hollow cylindrical member 88 is a biasing spring 111 that functions to yieldably resist inward movement of the actuating assembly 108.

Tensioning mechanism 132 includes a manually operated, operating assembly 112 that is identical in construction and operation to that previously described. As in the last described embodiment of the invention, the tensioning step is accomplished by inserting the outboard end of the manually operated, operating assembly 112 into the tensioning mechanism in a manner such that splines 110*a* of actuating driver 110 are received within the multiplicity of circumferentially spaced spline receiving grooves 118*a* of the operating assembly 112. Manual rotation of the operating assembly 112 will controllably rotate the actuating driver 110, which will rotate the driving member 90 and, in turn, will rotate driven member 104 and connector plate 100. Rotation of the connector plate 100 will cause the arcuate shaped spring engaging segment 102 to controllably twist the torsion spring 94 and controllably rotate the spool 134. In this way the resistance offered to the rotation of the circular shaped cable spool 134 about which the continuous cable 130 is entrained can be selectively controlled.

As before, as the water flows through the fluid flow channel "C" and impinges on the control vanes 64, the lower portions of the control vanes will tend to move outwardly in the manner shown in FIG. 13 of the drawings. However, since the lower portions of the control vanes are interconnected with the cable 130, the cable will yieldably resist the outward movement of the control vanes, which outward movement is tending to move the cable into an arcuate configuration (FIG. 13). It is apparent that the degree of tension placed on the continuous cable 130 controls the amount of force that must be imparted on the control vanes by the flowing fluid to move the cable into the arcuate configuration shown in FIG. 13.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

We claim:

1. A fluid flow control and debris intercepting apparatus for controlling flow through a structure having an opening defining a fluid flow channel comprising:

(a) first and second side panels connected to the structure;

(b) a support member connected to said first and second side panels and spanning the opening defining the fluid flow channel;

(c) a plurality of transversely spaced apart flow control vanes carried by said support member for controlling fluid flow through the fluid flow channel, each of said flow control vanes having an upper portion, a lower portion and an intermediate portion and being movable between a first position and a second position permitting an increase in the volume of fluid flow through the fluid flow channel;

(d) a yieldably deformable biasing member comprising an elongated cable connected to each of said flow control vanes proximate the intermediate portions thereof for resisting movement of each of said flow control vanes toward said second position; and (e) a tensioning mechanism carried by one of said first and second side panels for controlling the tension in said elongated cable, said tensioning mechanism comprising a spring operable associated with said elongated cable.

2. The apparatus as defined in claim 1 in which said tensioning mechanism comprises:

(a) a rotatable cable spool connected to said cable;

(b) a torsion spring connected to said cable spool for yieldably resisting rotation of said cable spool; and (c) a tensioning assembly operably associated with said torsion spring for controllably twisting said torsion spring.

3. The apparatus as defined in claim 1 in which said tensioning mechanism comprises:

(a) a connector plate connected to one of said first and second side panels;

(b) a hollow cylindrical member connected to said connector plate and extending there from, said hollow cylindrical member including a driving member;

(c) a cable spool circumscribing said hollow cylindrical member and connected to said cable;

(d) a helical torsion spring circumscribing said hollow cylindrical member and connected to said cable spool; and (e) tensioning assembly connected to said torsion spring for twisting said torsion spring, said tensioning assembly, including a driven member operably associated with said driving member.

4. A fluid flow control and debris intercepting apparatus for controlling flow through a structure having an opening defining a fluid flow channel comprising:

(a) first and second side panels connected to the structure;

(b) a support member connected to said first and second side panels and spanning the opening defining the fluid flow channel;

(c) a plurality of transversely spaced apart flow control vanes carried by said support member for controlling fluid flow through the fluid flow channel, each of said flow control vanes having an upper portion, a lower portion and an intermediate portion and being movable between a first position and a second position permitting an increase in the volume of fluid flow through the fluid flow channel;

(d) an elongated cable connected to each of said flow control vanes proximate the intermediate portions thereof for resisting movement of each of said flow control vanes toward said second position; and (e) a tensioning mechanism carried by one of said first and second side panels and connected to said elongated cable for controlling the tension in said elongated cable.

5. The apparatus as defined in claim 4 in which each of said upper portion of each of said flow control vanes is provided with a transverse bore constructed and arranged to slidably receive said support member.

6. The apparatus as defined in claim 4 in which said tensioning mechanism comprises:

(a) a rotatable cable spool connected to said cable;

(b) a torsion spring connected to said cable spool for yieldably resisting rotation of said cable spool; and (c) a tensioning assembly operably associated with said torsion spring for controllably twisting said torsion spring.

7. The apparatus as defined in claim 4 in which said tensioning mechanism comprises:

(a) a connector plate connected to said first side panel;

(b) a hollow cylindrical member connected to said connector plate and extending there from, said hollow cylindrical member including a driving member;

(c) a cable spool circumscribing said hollow cylindrical member and connected to said cable;

(d) a helical torsion spring circumscribing said hollow cylindrical member and connected to said cable spool; and (e) tensioning assembly connected to said torsion spring for twisting said torsion spring, said tensioning assembly, including a driven member operably associated with said driving member.

8. The apparatus as defined in claim 7, further including an operating assembly operably associated with said driven member of said tensioning assembly for controllably rotating said driven member.

9. The apparatus as defined in claim 8 in which said operating assembly includes a connector end movable within said hollow cylindrical member between a first position spaced apart from said driving member and a second advanced position.

10. The apparatus as defined in claim 9 further including a biasing spring disposed within said hollow cylindrical member for yieldably resisting movement of said operating member between said first position and said second position.

11. A fluid flow control and debris intercepting apparatus for controlling flow through a structure having an opening defining a fluid flow channel comprising:

(a) first and second side panels connected to the structure;

(b) a support member connected to said first and second side panels and spanning the opening defining the fluid flow channel;

(c) a plurality of transversely spaced apart flow control vanes carried by said support member for controlling fluid flow through the fluid flow channel, each of said flow control vanes having an upper portion, a lower portion and an intermediate portion and being movable between a first position and a second position permitting an increase in the volume of fluid flow through the fluid flow channel;

(d) an elongated cable connected to each of said flow control vanes proximate the intermediate portions thereof for resisting movement of each of said flow control vanes toward said second position;

(e) a tensioning mechanism carried by one of said first and second side panels and connected to said elongated cable for controlling the tension in said elongated cable, said tensioning mechanism comprising a connector plate connected to one of said first and second side panels; a hollow cylindrical member connected to said connector plate and extending there from, said hollow cylindrical member including a driving member; a cable spool circumscribing said hollow cylindrical member and connected to said cable; a helical torsion spring circumscribing said hollow cylindrical member and connected to said cable spool; and a tensioning assembly connected to said torsion spring for twisting said torsion spring, said tensioning assembly, including a driven member operably associated with said driving member; and (f) an operating assembly operably associated with said driven member of said tensioning assembly for controllably rotating said driven member.

12. The apparatus as defined in claim 11 in which each of said upper portion of each of said flow control vanes is provided with a transverse bore constructed and arranged to slidably receive said support member.

13. The apparatus as defined in claim 11 in which said operating assembly includes a connector end movable within said hollow cylindrical member between a first position spaced apart from said driving member and a second advanced position.

14. The apparatus as defined in claim 13 further including a biasing spring disposed within said hollow cylindrical member for yieldably resisting movement of said operating member between said first position and said second position.

* * * * *